US008436781B1

(12) United States Patent
Miller

(10) Patent No.: US 8,436,781 B1
(45) Date of Patent: May 7, 2013

(54) WHIP ANTENNA ASSEMBLY WITH LIFT CABLE

(75) Inventor: Paul E. Miller, Spring Lake, MI (US)

(73) Assignee: R.A. Miller Industries, Inc., Grand Haven, MI (US)

( * ) Notice: Subject to any disclaimer, the term of this patent is extended or adjusted under 35 U.S.C. 154(b) by 590 days.

(21) Appl. No.: 12/819,433

(22) Filed: Jun. 21, 2010

Related U.S. Application Data

(60) Provisional application No. 61/249,695, filed on Oct. 8, 2009, provisional application No. 61/327,424, filed on Apr. 23, 2010.

(51) Int. Cl.
*H01Q 1/40* (2006.01)
*H01Q 9/30* (2006.01)

(52) U.S. Cl.
USPC ..... 343/873; 343/900

(58) Field of Classification Search ..... 343/873, 343/900, 903
See application file for complete search history.

(56) References Cited

U.S. PATENT DOCUMENTS 7,477,200 B2 * 1/2009 Parsche ..... 343/702

FOREIGN PATENT DOCUMENTS

EP 0083262 A1 * 12/1982

* cited by examiner

*Primary Examiner* — Robert Karacsony
(74) *Attorney, Agent, or Firm* — McGarry Bair PC

(57) ABSTRACT

A whip antenna assembly having an electrically conductive coupler, opposing stacks of discrete blades of varying heights nested together, and a flexible lift cable having a length greater than the first and second opposing stacks. Where the conductive blades are loosely held together for slidable movement relative to each other. The whip antenna assembly can be lifted by the distal end of the flexible lift cable without interfering with the opposing stacks, while remaining flexible enough to bend.

16 Claims, 9 Drawing Sheets

WHIP ANTENNA ASSEMBLY WITH LIFT CABLE

CROSS REFERENCE TO RELATED APPLICATIONS

This application claims the benefit of U.S. Provisional Patent Application Ser. No. 61/327,424, filed Apr. 23, 2010 and U.S. Provisional Patent Application Ser. No. 61/249,695, filed Oct. 8, 2009.

BACKGROUND OF THE INVENTION

1. Field of the Invention

The invention relates to the construction of whip antennas from discrete blades.

2. Description of the Related Art

The physical size of an antenna largely depends upon the purpose for which it is to be employed. For example, an antenna for receiving a particular frequency range must have an electrical length capable of resonating within that range to achieve optimum reception. Generally, lower frequencies require longer lengths because the wavelengths at lower frequencies are longer, but limitations in use often demand design modifications to achieve appropriate electrical length in a smaller space. A whip antenna is an example of a widely used antenna. It has a thin flexible core and may be attached to a vehicle; the name is derived from the whip-like motion of the antenna when disturbed. It is not uncommon for such antennas to be 10 feet or more in length.

FIGS. 1-4 illustrate prior art constructions of whip antenna assemblies. FIGS. 1 and 2 show a well-known prior art construction of a whip antenna assembly 10 comprising a number of pairs of leaves 12 nested together in a stack 13 and secured to each other by rivets 14. Each leaf or blade is curved in cross section much like a tape measure, and each pair has a different length. The longest pair 12A is stacked in the middle, and sandwiched between the two leaves of the next longest pair, which are in turn sandwiched between the two leaves of the next longest pair and so on. The distal end of each leaf has an elongated slot, and each interior leaf of the stack has an elongated slot in registry with the distal elongated slots so that a rivet can extend through the elongated slots in the stack. The rivets are not tight, thus enabling the stack to bend as shown in FIG. 3.

The proximate end 16 of the stack 13 is secured to a coupler 18 which comprises a connector 20 to enable an electrical connection to a receiver or transmitter. A hook and loop strap 22 is attached to the stack near the proximate end 16 so that when the distal end 24 of the antenna is bent against itself it can be secured by the hook and loop strap to make it easier to transport the antenna.

A hole is often provided near the distal end of the longest pair of leaves so that a line can be attached to the distal end of the antenna. In the field, such a line enables the antenna to be pulled up into a tree or other object for mounting at a higher elevation to improve transmission and reception of signals via the antenna.

One of the problems with the prior art design of FIGS. 1 and 2 is that dirt and other contaminants become lodged between the leaves of the stack. Such contaminants interfere with the bending of the stack for transport and eventually degrade the durability of the antenna.

A solution to the problem was found in the prior art antenna assembly 30 of FIG. 4. Here, two stacks 32, 34 of leaves or blades, preferably arcuate in cross section, are secured at a proximal end 36 thereof to a fusiform pin 38 extending from an electrically conductive coupler 40 that preferably matches the curvature of the blades. The proximal end of each stack 32, 34 is fixedly secured to the pin 38 on opposite sides thereof by rivets 42, 44, and each stack comprises a nested number of blades of different lengths with the longer blades on the outside of the stack and shorter blades on the inside of the stack. The remaining portions of the blades are free to slidably move relative to each other as the stacks 32, 34 are bent. The entire assembly is covered with a heat shrink wrap (not shown) that protects the stacks from the introduction of contaminants and water, yet enables the leaves or blades to move relative to each other so that the whip antenna can be folded for ease of transport. A cap (not shown) is typically glued or welded to the heat shrink wrap at the distal end.

One of the problems with the prior art design of FIG. 4 is that there is no easy and effective way to secure a line to the distal end of the antenna. Adding a hole to the distal end compromises the integrity of the heat shrink wrap. As well, the bond between the cap and the heat shrink wrap may not be strong enough to enable a line to be secured to the cap and pull the antenna and associated structures by way of the cap. Either the cap will become dislodged or if the bond is strong enough, the heat shrink wrap will inelastically deform when the line pulls the structure against gravity.

SUMMARY OF THE INVENTION

A whip antenna according to the invention includes an electrically conductive coupler having a pin extending therefrom, first and second opposing stacks of conductive blades of varying heights nested together, each of the first and second stacks being conductively secured at a proximal end to opposing sides of the pin, the remainder of the conductive blades being loosely held together for slidable movement relative to each other, and a flexible lift cable having a length greater than the first and second opposing stacks, with a proximal end secured to the pin, and nested between the first and second opposing stacks with a distal end extending beyond the length of the first and second opposing stacks. The whip antenna assembly can be lifted by the distal end of the flexible lift cable without interfering with the first and second opposing stacks, while remaining flexible enough to bend. Preferably, the lift cable is conductive.

The lift cable may be secured to the pin by a conductive solder. The cable may be at least one of a flexible stranded stainless steel cable and a flexible braided stainless steel cable. The whip antenna assembly may also include a dielectric coating provided at the distal end of the flexible lift cable. Preferably, the dielectric coating is vinyl.

Preferably, the distal end of the flexible lift cable is looped and secured by a sleeve. The whip antenna assembly may also include a heat shrink wrap over all but the loop, wherein a portion of the heat shrink wrap is glued to a distal portion of the whip antenna assembly to secure the heat shrink wrap.

Preferably, the distal portion of the whip antenna assembly comprises a fastener to secure it to another portion of the whip antenna assembly when the whip antenna assembly is folded back onto itself.

The whip antenna assembly may include a spacer nested over the outermost conductive blade of each of the first and second stacks and secured to each other but not to the stacks and a heat shrink wrap over all but the distal end of the flexible lift cable whereby the outermost conductive blades are free to slide relative to the spacer and relative to adjacent blades within the respective stacks without interference with the heat shrink wrap. Preferably, the heat shrink wrap is glued to the distal portion of the whip antenna assembly to secure the heat shrink wrap. Preferably, the spacers extend the entire length of the glued portion of the heat shrink wrap. Preferably, the spacer is a short blade having the same arcuate shape as the stack.

DETAILED DESCRIPTION OF THE DRAWINGS

Figure 1:
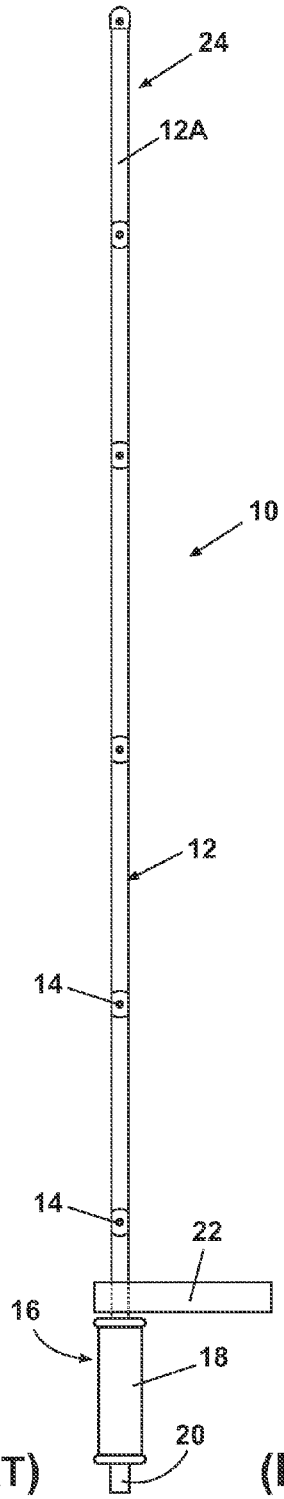
Fig. 1 (PRIOR ART)
FIG. 1 is a side view of a whip antenna assembly of the prior art.
Figure 2:
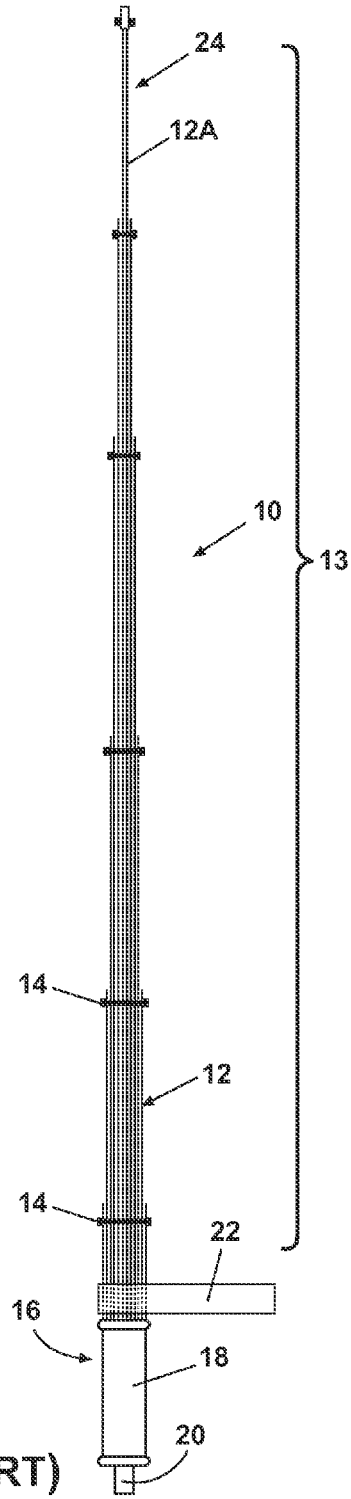
Fig. 2 (PRIOR ART)
FIG. 2 is a front view of the prior art whip antenna assembly of FIG. 1.
Figure 3:
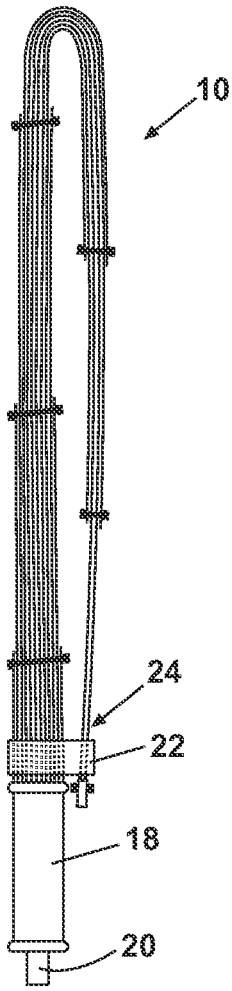
Fig. 3 (PRIOR ART)
FIG. 3 is a front view of the prior art whip antenna assembly of FIGS. 1 and 2 in a folded position.
Figure 4:
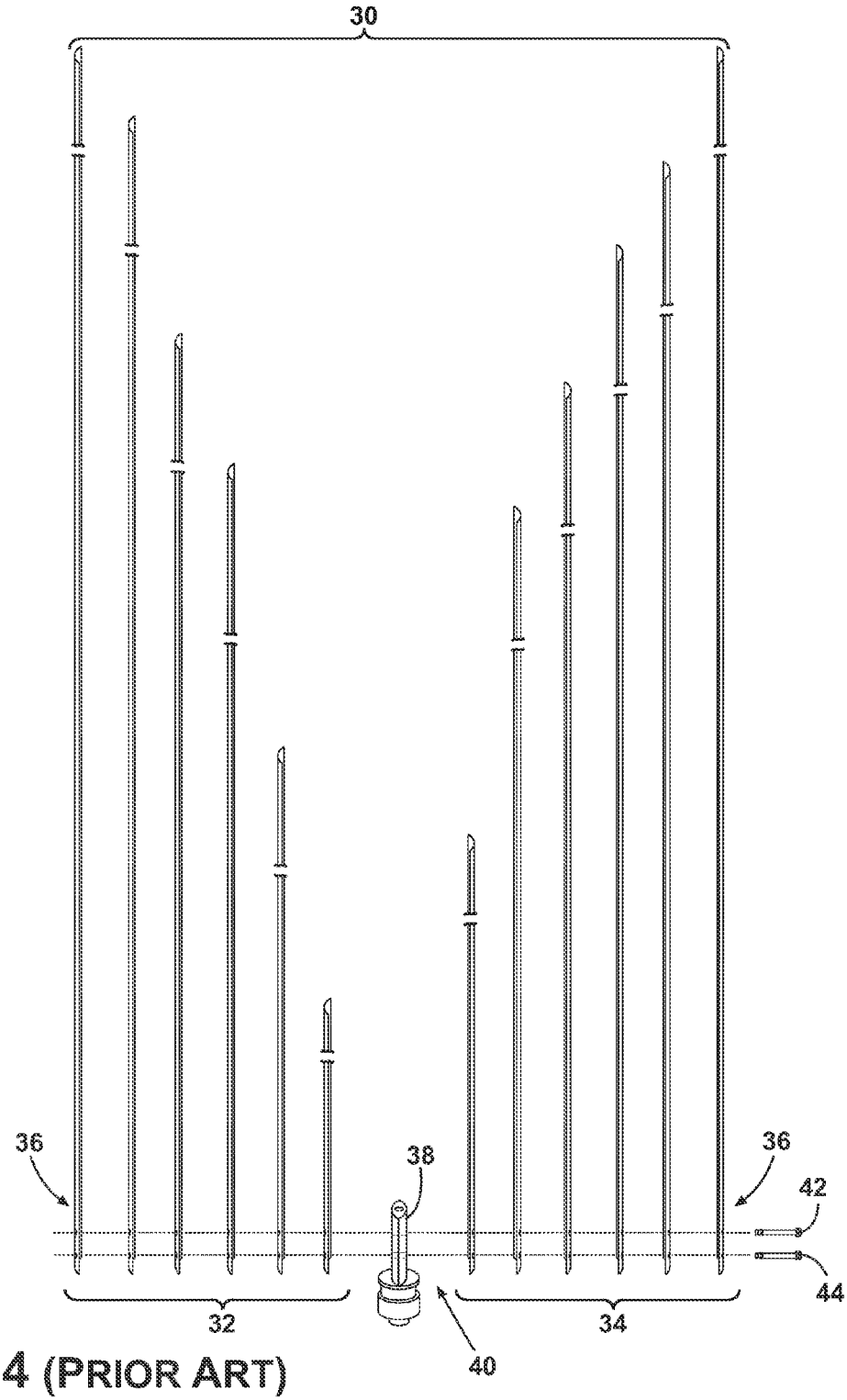
Fig. 4 (PRIOR ART)
FIG. 4 is an exploded view of another prior art whip antenna assembly.
Figure 5:
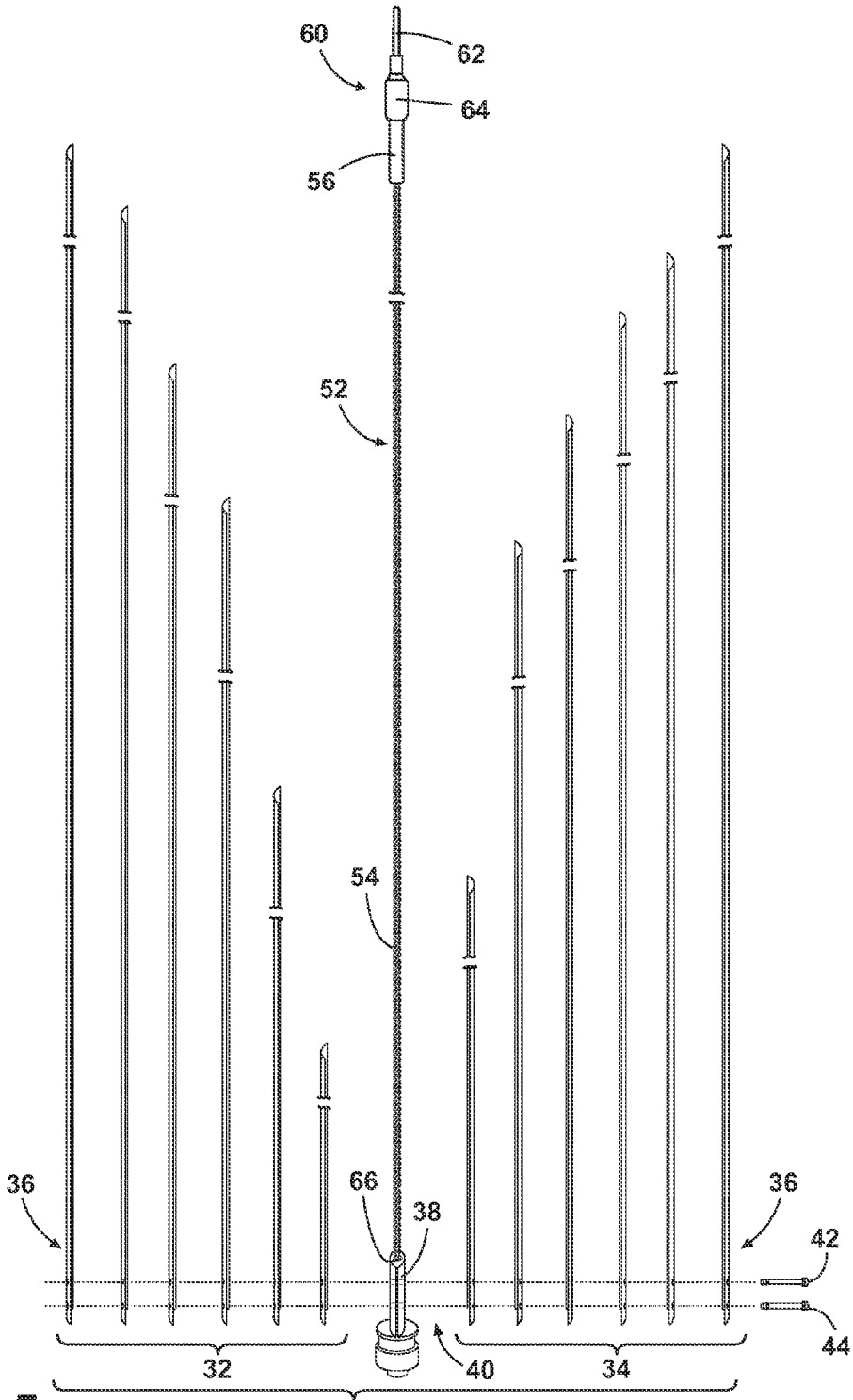
FIG. 5 is an exploded view of a whip antenna assembly according to a first embodiment of the invention.
Figure 6:
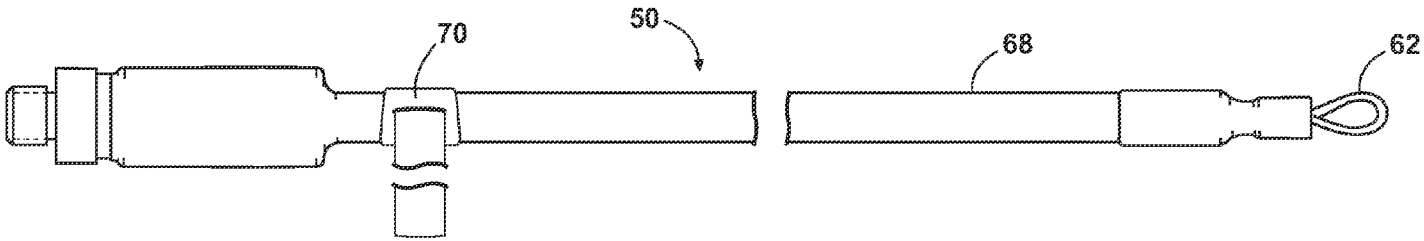
FIG. 6 is a front view of the whip antenna assembly of FIG. 5.
Figure 7:
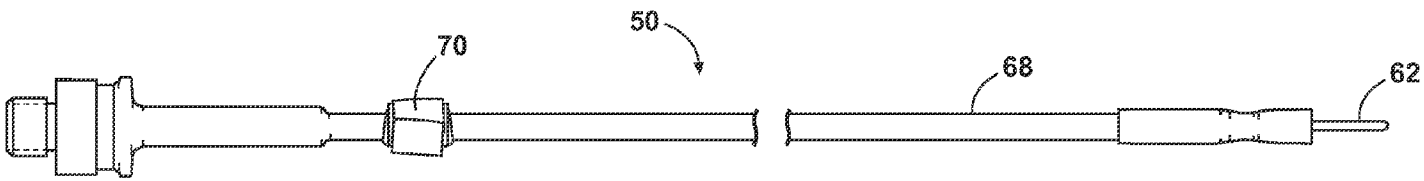
FIG. 7 is a side view of the whip antenna assembly of FIGS. 5 and 6.
Figure 8:
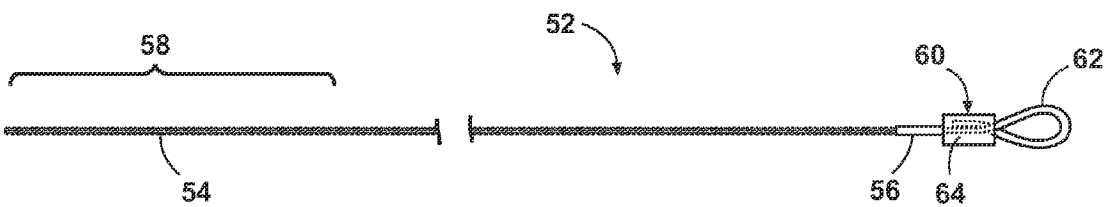
FIG. 8 is a side view of the lift cable used in the whip antenna assembly of the invention.

FIGS. 5-8 illustrate a whip antenna assembly 50 according to the invention, with a blade structure similar to that of FIG. 4. Like numbers will identify like parts. According to the invention, a lift cable 52 is provided at a center of the whip assembly between the opposing stacks 32, 34 of blades. The lift cable 52, illustrated in greater detail in FIG. 8, is preferably made of a flexible, stranded or braided stainless steel cable 54. An exemplary material includes 302/304 stainless steel with a 7×7 strand core. A dielectric coating 56 is provided at the distal end 60 of the cable to protect exposed portions that will extend beyond the heat shrink wrap 68 (see below). A preferable dielectric coating includes vinyl. The distal end 60 of the cable is looped 62 and secured by a sleeve 64.

The proximate end 58 of the steel cable 54 is secured in an axially drilled hole 66 in the pin 38 of the coupler 40 by a conductive solder, such as silver. The entire assembly 50, except for the loop 62, is shrouded with a heat shrink wrap 68 as shown in FIGS. 6 and 7. A fastener 70 such as a hook and loop fastener is secured to the whip assembly above the coupler 38 near its proximate end 36. It will be apparent that the proximal end of the lift cable 52 and the proximal end of each stack 32, 34 are fixedly secured to the coupler 40, preferably by rivets 42, 22. It will also be apparent that the distal ends of the leaves in each stack 32, 34 and the lift cable 52 are free to move relative to each other within the heat shrink wrap 68 to enable the distal end 60 of the whip assembly 50 to be folded back upon itself and secured by the hook and loop fastener 70. In fact, the whip antenna assembly 50 is flexible enough to enable more than one fold to be secured by the fastener 70, with enough elasticity to enable the whip assembly to be restored to its full length without deformation upon release of the fastener.

The loop 62 enables a line to be secured to the distal end of the whip assembly 50 so that it can be pulled in the field to a higher elevation for use. The lift cable 62 is secured only to the pin 38 of the coupler 40 so that, in effect, the force of lifting the whip antenna assembly is carried by the coupler at the proximal end of the whip. The lift cable 62 is preferably conductive so that it also serves as the longest radiator in the antenna, having a length dependent on the optimal frequency for transmission or reception by the equipment electrically connected to the coupler. It is within the scope of the invention for the lift cable 62 to be non-conductive, however.

Figure 9:
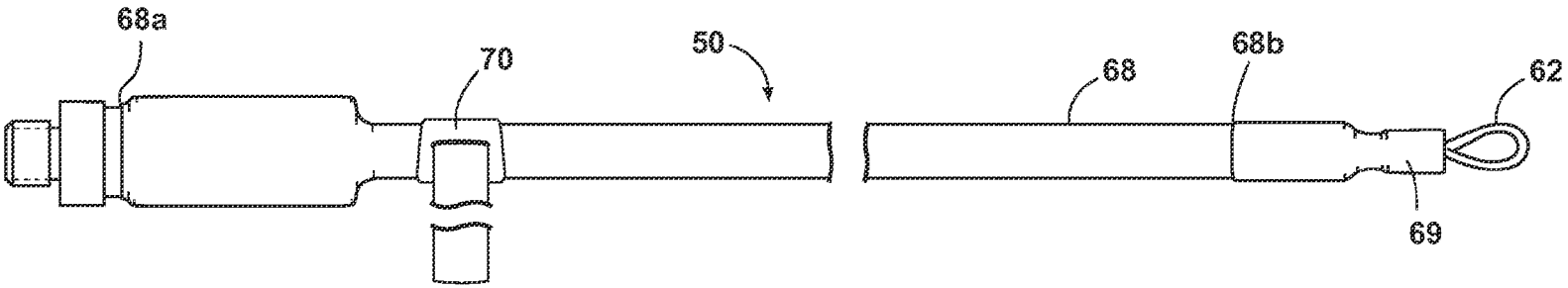
FIG. 9 is a side view of the whip antenna assembly of FIG. 7 rotated 90 degrees.

An alternative arrangement for the shrink wrap is show in FIG. 9. A first portion of the shrink wrap 68 extends from the base at 68*a* to the tip of the stacks at 68*b*. A second glued portion 69 extends from the distal end 69*a* of the sleeve 64 to a point 69*b* spaced from the distal end of the stack, and glued to the sleeve and to the first portion to help secure the assembly 50. Whether in the embodiment of FIGS. 6 and 7, or the embodiment of FIG. 9, it has been observed in some circumstances that the shrink wrap may hinder the movement of the longer blades, especially the longer blades on the outside of the stacks 32, 34 when the whip antenna 50 is folded.

Figure 10:
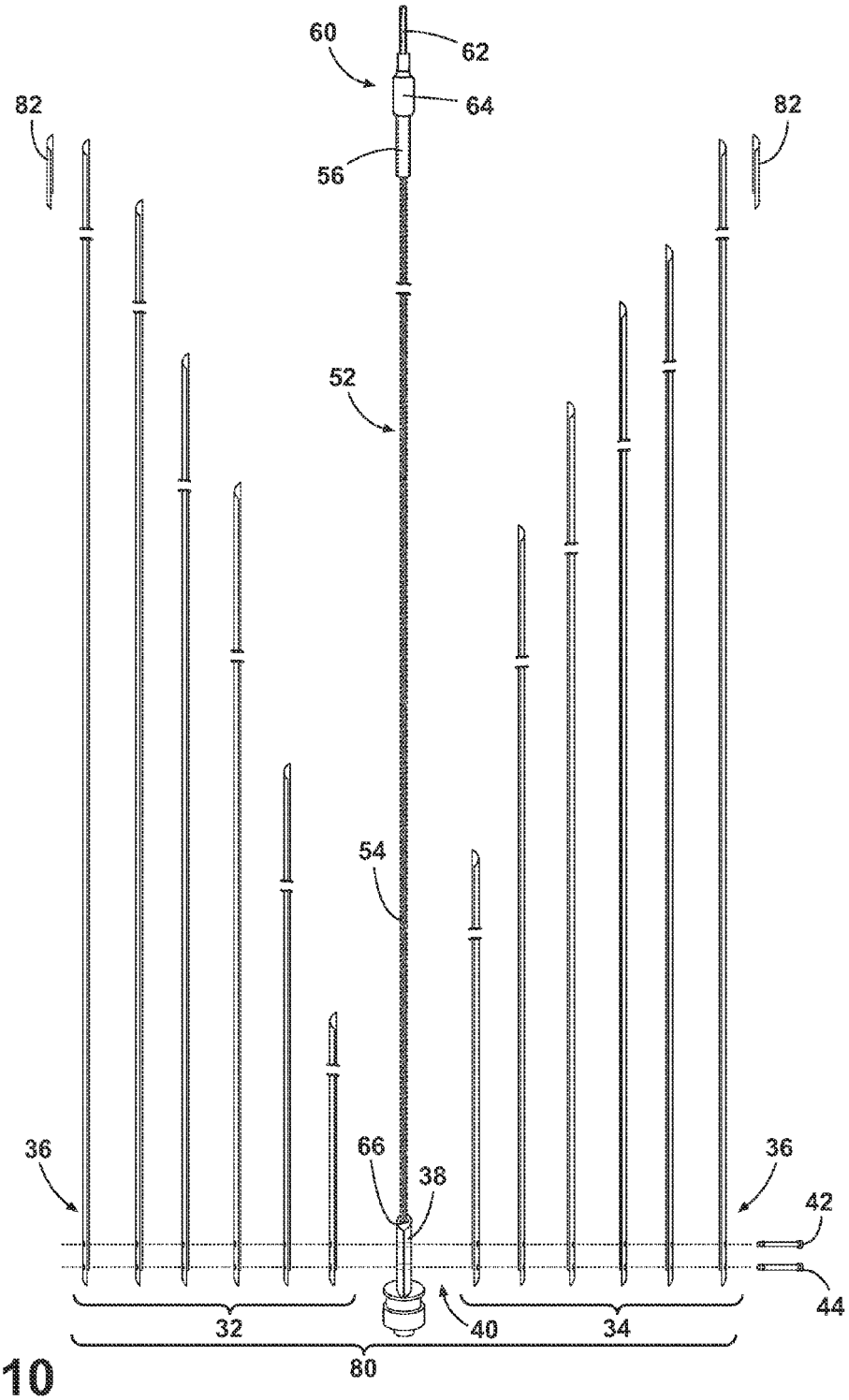
FIG. 10 is an exploded view of a whip antenna assembly according to a second embodiment of the invention.
Figure 11:
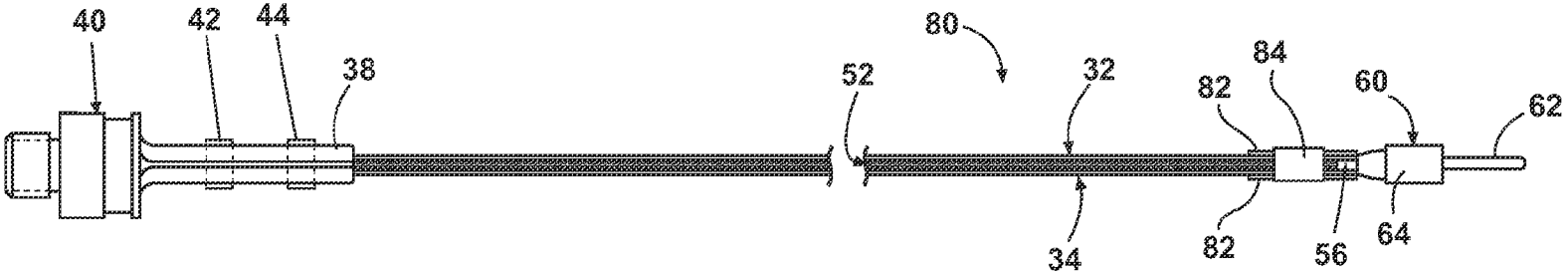
FIG. 11 is a side view of the whip antenna assembly of FIG. 10, assembled before shrink wrap.

A solution to this problem is found in the whip antenna assembly 80 according to the invention as shown in FIGS. 10-11. It can be seen in FIG. 10 that a whip antenna assembly 80 according to the invention has a structure similar to that of FIG. 5. Like numbers will identify like parts. However, it can be seen that according to the invention, two spacers 82 are provided on the outside of the longer blades of the opposing stacks 32, 34 at the distal end 60 of the assembly 80. The two spacers 82 preferably have the same shape as the blades of the stacks.

Figure 12:
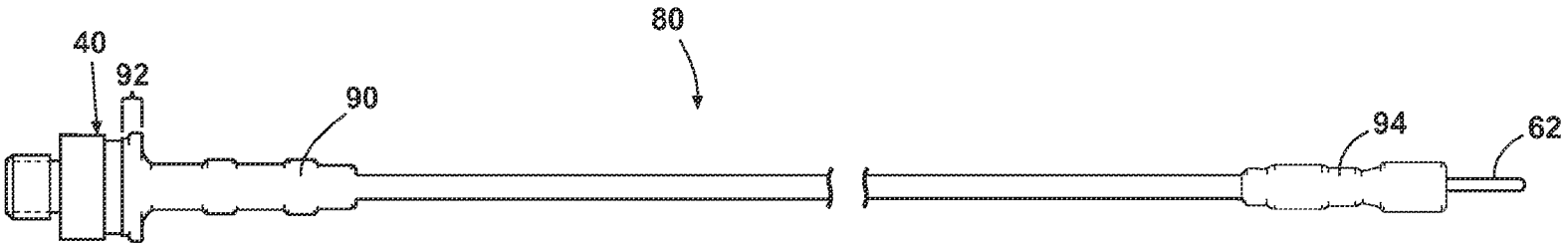
FIG. 12 is a side view of the whip antenna assembly of FIGS. 10 and 11.

As illustrated in FIG. 11 the two spacers 82 are secured to each other at the distal ends of the longer blades in each stack 32, 34 by an adhesive tape 84 wrapped around both stacks, but adhered only to the two spacers 82. Then, looking at FIG. 12, the entire assembly 80, except for the loop 62, may be shrouded with a heat shrink wrap, preferably a first portion 90 extending to the end of the stacks, portion 92 of which may be glued to the coupler 40 to secure it. A second glued portion 94, extends from the sleeve 64 to affix to and preferably cover the first portion 90 over the two spacers 82. The second portion is preferably glued to the first portion 90 at the sleeve 64 and the spacers 82. It will be apparent that the movement of the two spacers 82 may be hindered by the shrink wrap, but that the distal ends of the leaves in each stack 32, 34 and the lift cable 52 are free to move relative to each other and relative to the two spacers 82 within the heat shrink wrap, regardless of the first portion 68 or the glued portion 69, to enable the distal end 60 of the whip assembly 80 to be folded back unhindered upon itself and secured by the hook and loop fastener 70.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims. For example, while the two spacers 82 have been illustrated as two short blades it has been contemplated that they may take other forms so long as they allow the distal ends of the leaves in each stack 32, 34 and the lift cable 52 to move relative to each other and relative to the two spacers within the heat shrink wrap.

What is claimed is:

1. A whip antenna assembly comprising:

an electrically conductive coupler having a pin extending therefrom;

first and second opposing stacks of conductive blades of varying heights nested together, each of the first and second stacks being conductively secured at a proximal end to opposing sides of the pin, the remainder of the conductive blades being loosely held together for slidable movement relative to each other; and a flexible lift cable having a length greater than the first and second opposing stacks, with a proximal end secured to the pin, and nested between the first and second opposing stacks with a distal end extending beyond the length of the first and second opposing stacks;

whereby the whip antenna assembly can be lifted by the distal end of the flexible lift cable without interfering with the first and second opposing stacks, while remaining flexible enough to bend.

2. The whip antenna assembly of claim 1 wherein the lift cable is secured to the pin by a conductive solder.

3. The whip antenna assembly of claim 1 wherein the cable is at least one of a flexible stranded stainless steel cable and a flexible braided stainless steel cable.

4. The whip antenna assembly of claim 1, further comprising a dielectric coating provided at the distal end of the flexible lift cable.

5. The whip antenna assembly of claim 4 wherein the dielectric coating is vinyl.

6. The whip antenna assembly of claim 4 wherein the distal end of the flexible lift cable is looped and secured by a sleeve.

7. The whip antenna assembly of claim 6, further comprising a heat shrink wrap over all but the loop, wherein a portion of the heat shrink wrap is glued to a distal portion of the whip antenna assembly to secure the heat shrink wrap.

8. The whip antenna assembly of claim 1 wherein the distal end of the flexible lift cable is looped and secured by a sleeve.

9. The whip antenna assembly of claim 8, further comprising a heat shrink wrap over all but the loop, wherein a portion of the heat shrink wrap is glued to a distal portion of the whip antenna assembly to secure the heat shrink wrap.

10. The whip antenna assembly of claim 9 wherein the distal portion of the whip antenna assembly comprises a fastener to secure it to another portion of the whip antenna assembly when the whip antenna assembly is folded back onto itself.

11. The whip antenna assembly of claim 1 wherein the lift cable is conductive.

12. A whip antenna assembly of claim 1, further comprising a spacer nested over the outermost conductive blade of each of the first and second stacks and secured to each other but not to the stacks; and a heat shrink wrap over all but the distal end of the flexible lift cable;

whereby the outermost conductive blades are free to slide relative to the spacers and relative to adjacent blades within the respective stacks without interference with the heat shrink wrap.

13. The whip antenna assembly of claim 12 wherein the heat shrink wrap is glued to the distal portion of the whip antenna assembly to secure the heat shrink wrap.

14. The whip antenna assembly of claim 13 wherein the spacers extend the entire length of the glued portion of the heat shrink wrap.

15. The whip antenna assembly of claim 13 wherein the distal portion of the whip antenna assembly comprises a fastener to secure it to another portion of the whip antenna assembly when the whip antenna assembly is folded back onto itself.

16. The whip antenna assembly of claim 12 wherein the spacer is a short blade having the same arcuate shape as the stack.

* * * * *